United States Patent [19]

Njegovan

[11] Patent Number: 4,783,855

[45] Date of Patent: Nov. 15, 1988

[54] INFANT PRESENTATION WRAP

[76] Inventor: Borka Njegovan, 7605 ½ S. Odell, Bridgeview, Ill. 60455

[21] Appl. No.: 109,063

[22] Filed: Oct. 16, 1987

[51] Int. Cl.[4] ..... A41D 11/00

[52] U.S. Cl. ..... 2/69.5; 2/84

[58] Field of Search ..... 2/69.5, 69, 80, 84, 2/75, 83

[56] References Cited

U.S. PATENT DOCUMENTS

| | | | |
|---|---|---|---|
| D. 156,466 | 4/1948 | Lustgarten | D92/2 |
| D. 271,071 | 10/1983 | Koether | D6/203 |
| D. 290,917 | 7/1987 | Rollins, Jr. | D6/589 |
| 1,583,419 | 5/1926 | Perl | 2/69.5 |
| 1,678,125 | 7/1928 | Petrescu | 2/69.5 |
| 2,008,919 | 7/1935 | Milkes | 2/84 X |
| 2,227,751 | 1/1941 | Idelman | 2/69.5 |
| 2,358,410 | 9/1944 | Matthesius | 2/69.5 |
| 2,538,420 | 1/1951 | Junghans | 2/69 |
| 2,546,057 | 3/1951 | Bodin et al. | 2/270 |
| 2,932,827 | 4/1960 | Munro, Jr. | 2/69.5 |
| 3,034,132 | 5/1962 | Landsberger et al. | 2/69.5 |
| 3,412,407 | 11/1968 | Key | 2/69.5 |
| 3,477,065 | 11/1969 | Hoover | 2/69.5 |
| 4,172,300 | 10/1979 | Miller | 5/424 |
| 4,316,287 | 2/1982 | Rule | 2/69.5 |
| 4,575,876 | 3/1986 | Weaver | 2/69.5 |
| 4,616,365 | 10/1986 | Lyons | 2/69 |

*Primary Examiner*—Louis K. Rimrodt
*Assistant Examiner*—J. L. Olds

[57] ABSTRACT

An infant presentation wrap and method comprises a structure providing an infant receiving pocket, an infant headrest extension on a back panel of the pocket structure and projecting substantially beyond an open end of the pocket. A front panel of the pocket structure may have separable flaps which are adapted to be spread apart to provide an opening aligned with the open top end for facilitating insertion of an infant to the pocket, with separable means such as ties on the flaps for retaining the flaps closed. An overlap extends from the closed bottom of the pocket structure and is of a length to be folded into substantial covering relation to the front panel. Generally aligned ribbon straps extend from intermediate opposite sides of the overlap and are of a length to enwrap the pocket structure and the folded overlap and are adapted to be tied into a retaining bow over the folded overlap.

12 Claims, 1 Drawing Sheet

INFANT PRESENTATION WRAP

BACKGROUND OF THE INVENTION

The present invention relates to a novel infant presentation wrap which is particularly useful for carrying and presenting an infant for special occasions.

Such occasions may occur when it is desired to present an infant more or less ceremonially, such as when the infant is first taken from the hospital, when the infant is presented for dedication or baptismal rites, or any other occasion when it is desired to present the infant in a formal or special manner. Heretofore, supports such as pillows, blankets, baskets, and the like have been used for this purpose.

SUMMARY OF THE PRESENT INVENTION

An important object of the present invention is to provide a new and improved infant presentation wrap.

Another object of the present invention is to provide an infant presentation wrap which will present the infant attractively, safely, and conveniently.

A further object of the invention is to provide an infant presentation wrap which is simple in construction, easy and convenient to use and which will serve not only as an efficient carrier, but also as a warm cover for the infant.

In accordance with the principles of the present invention, there is provided an infant presentation wrap, comprising an infant receiving pocket structure having a pocket defined by and between a back panel and a front panel and provided with an open top end, closed sides and a closed bottom end. An infant headrest extension on said back panel projects substantially beyond the open end. The front panel may have separable flaps which are adapted to be spread apart to provide an opening aligned with the open top end for facilitating insertion of an infant into the pocket, and separable means on the flaps for retaining the flaps closed. An overlap extends from the closed bottom end and is of a length to be folded into substantially covering relation to the front panel. Generally aligned tie ribbons or straps extend from intermediate opposite sides of the overlap and are of a length to enwrap the pocket structure and the folded overlap and are adapted to be tied into a retaining bow over the folded overlap.

BRIEF DESCRIPTION OF THE DRAWINGS

Other objects, features and advantages of the present invention will be readily apparent from the following description of a representative embodiment thereof, taken in conjuction with the accompanying drawing, although variations and modifications may be effected without departing from the spirit and scope of the novel concepts embodied in the disclosure, and in which.

DETAILED DESCRIPTION

Figure 1:
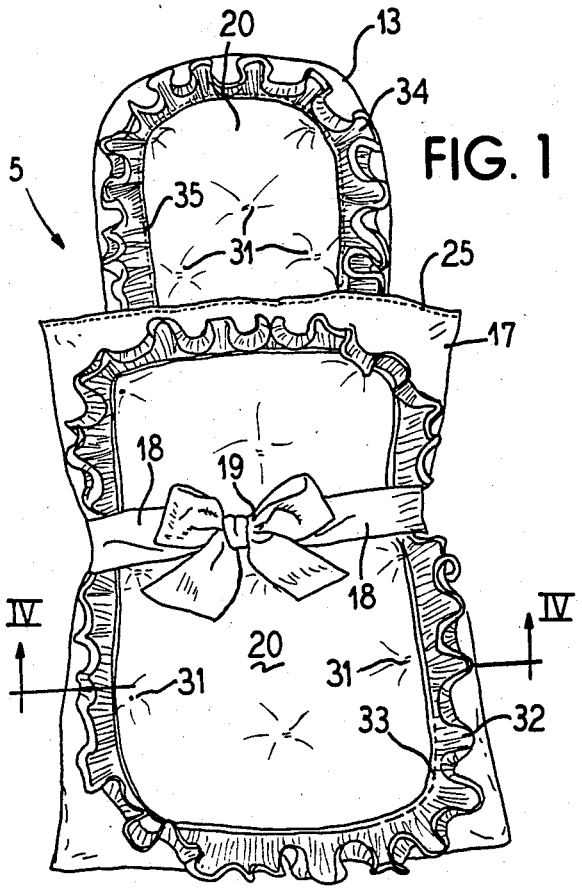
FIG. 1 is a front plan view of an infant presentation wrap embodying the present invention.

An infant presentation wrap 5 embodying the present invention, and as shown in the drawing, comprises an infant receiving pocket structure 7 defining a pocket 7*a* by and between a back panel 8 and a front panel 9. The pocket structure 7 has an open top end 1O, closed opposite sides 11 and a closed bottom end 12. An infant headrest extension 13 on the back panel 8 projects substantially beyond the open end 10.

Figure 3:
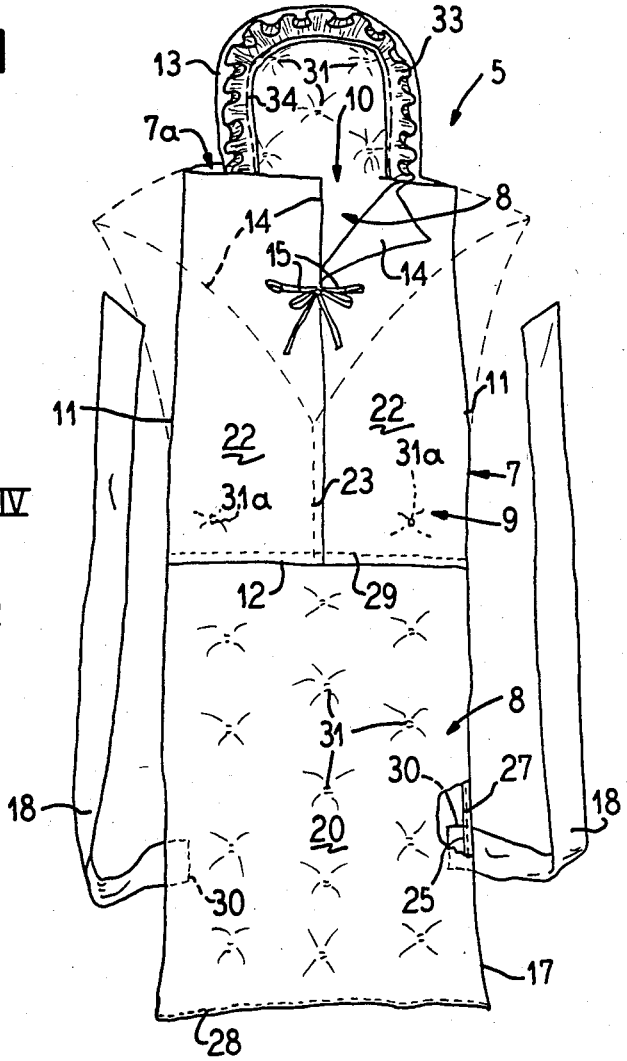
FIG. 3 is a front plan view of the infant presentation wrap spread open, and on a slightly smaller scale than in FIGS. 1 and 2.
Figure 4:
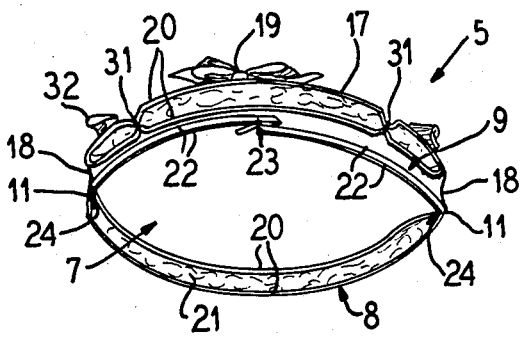
FIG. 4 is a sectional detail view taken substantially along the line IV—IV in FIG. 1, but on a somewhat smaller scale.

The front panel 9 may have separable flaps 14 which are adapted to be spread apart as shown in phantom outline in FIG. 3 to provide an opening aligned with the open top end 1O for facilitating reception of an infant in the pocket 7. Separable means comprising ties 15 on the flaps 14 are provided for retaining the flaps closed when the ties are tied together but will release the flaps to be spread open when the ties are untied.

Figure 2:
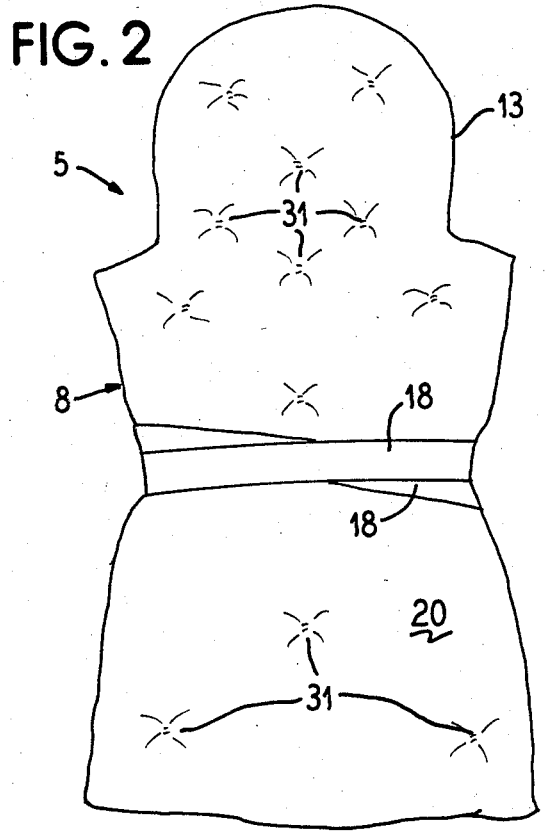
FIG. 2 is a rear plan view of the infant presentation wrap of FIG. 1.

An overlap 17 extends from the closed bottom end 12 and is of a length to be folded into substantially covering relation to the front panel 9. Generally aligned tie ribbons or straps 18 extend from intermediate the opposite sides of the overlap 17 and are of a length to enwrap the pocket structure 7 and the folded overlap as best seen in FIGS. 1 and 2. When tied into a bow 19 over the folded overlap, the straps 18 retain the overlap 17 in place. Preferably, the ribbon straps 18 are constructed as neatly finished flattened fabric tubes.

In a preferred construction, the back panel 8 comprises two substantially coextensive fabric sheets 20 having cushioning and insulating padding 21 therebetween. The front panel 9 desirably comprises a pair of overlapped fabric sheets 22 which may be continuous along the lower end of the pocket structure 7 but, as shown, may comprise two double sheet sections joined together along the longitudinal center of the front panel for a short length adjacent to the bottom end 12 by means of stitching 23. Along the side edges of the front panel 9, the dual sheets 22 may have their margins 24 sandwiched between side margins of the back panel sheets 20 and secured in place by means of stitching 24.

The back panel sheets 20 are desirably identical and coextensive, and each sheet 20 is continuous throughout the length of the back panel 8 of the pocket structure 7 as well as the headrest extension 13 and the overlap 17. Along their side and top end edges the sheets 20 are secured together by an inturned hemmed seam 25 secured by stitching 27. Along their lower ends the sheets 20 are turned in upon themselves in a hem and seamed as by means of a line of stitching 28. The lower ends of the front panel sheets 22 are turned in upon themselves in a hem nd secured into a seam as by means of a line of stitching 29 which also secures this seam to the top sheet 20 of the back panel 8.

Each of the tie ribbon straps 18 has its proximal end 30 secured to the overlap 17 intermediate its length by insertion between the side margines of back panel sheets 20 and secured to and between the inturned edge seam 25 by means of the stitching 27.

For strengthening the overall construction, an array of spaced tie stitches 31 secures the sheets 20 of the back panel 8 together. The stitches 31 extend through the padding 21 and not only retain the sheets 20 but also the padding 21 against displacement. At least two of the tie stitches 31*a* secure the lower end corner portions of the front panel 9 to the back panel 8.

Decorative means such as a lace trim border 32 may be applied to the surface of the overlap 17 which will face upwardly in the folded position of the overlap. Desirably the lace trim 32 may be secured as by means of stitching 33 to the bottom sheet 20 of the back panel 8. Similarly, a decorative lace border 34 may be secured to the front face of the headrest extension 13 as by means of stitching 35 attaching the lace to the upper sheet 20 of the base panel 8.

In use of the infant presentation wrap 5, it is laid out as shown in FIG. 3 and the flaps 14 are opened as shown in dash outline. After the infant has been placed in the pocket *7a* with its head above the opening 10 and resting on the headrest 13, the flaps 14 are closed into wrapping relation to the infant, with the upper edges of the flaps under the infant's chin. The ties 15 are then secured together in a separable bow knot to serve as a first stage retention of the infant in the pocket *7a*. Next, the overlap 17 is folded up over the front panel 22 of the pocket structure 7, and the tie ribbon straps 18 are wrapped from each respective side of the overlap 17 across the underside of the pocket structure 7 and continuing over the front of the folded overlap 17 and tied into the bow knot 19. When thus tied, the tie straps 18 can be pulled in slightly as shown in FIGS. 1 and 2, about the padded wrap for firmly but comfortably holding the infant in place in the pocket *7a*. By having the straps 18 located to wrap around the pocket *7a* at about the waist region above the hips of an infant in the pocket *7a*, special infant-retaining assurance is attained.

All edges of the presentation wrap are neatly finished. Any preferred fabric may be used in producing the wrap 5, sateen having been found to be an excellent material because of its strength and lustrous appearance.

It will be understood that variations and modification may be effected without departing from the spirit and scope of the novel concepts of the present invention.

I claim as my invention:

1. An infant presentation wrap, comprising:

an infant receiving pocket structure having a pocket defined by and between a back panel and a front panel and provided with an open top end, closed sides and a closed bottom end;

an infant headrest extension on said back panel projecting substantially beyond said open end;

an overlap extending from said closed bottom end and being of a length about equal to said pocket so as to be foldable into substantially covering relation to said front panel; and generally aligned tie ribbon straps extending intermediately from opposite sides of said overlap and of a length to enwrap said pocket structure and the folded overlap and adapted to be tied into a retaining bow over the folded overlap.

2. An infant presentation wrap according to claim 1, wherein said front panel has separable flaps which are adapted to be spread apart to provide an opening aligned with said open top end for facilitating insertion of an infant into said pocket, separable means on said flaps for retaining said flaps closed, and ornamental border decorations on said headrest and on that face of the overlap which faces outwardly when the overlap is folded over onto said front panel.

3. An infant presentation wrap according to claim 1, wherein said back panel comprises double sheet material with cushioning padding therebetween.

4. An infant presentation wrap according to claim 1, wherein said front panel comprises a pair of sections joined along substantially the longitudinal center of the pocket structure and being partially separable along said flaps.

5. An infant presentation wrap according to claim 1, wherein said bottom end of said pocket structure is secured to said back panel by a line of stitching.

6. An infant presentation wrap according to claim 1, wherein said back panel comprises a pair of similar coextensive sheets which extend throughout the length of said back panel including said headrest extension and said overlap.

7. An infant presentation wrap according to claim 1, wherein said aligned tie ribbon straps are of flat tubular construction.

8. An infant presentation wrap according to claim 1 wherein said back panel comprises overlapped sheets secured together along side edges, and proximal ends of said tie ribbon straps are fixidly anchored to said sheets at said side edges.

9. An infant presentation wrap according to claim 1, wherein said back panel comprises front and back facing sheets and a fill of padding between said sheets, and an array of tie stitches connecting said sheets through said padding.

10. An infant presentation wrap according to claim 9, wherein certain of said tie stitches secure said pocket structure front panel to said back panel sheets.

11. A method of utilizing an infant presentation wrap, including an infant receiving pocket structure having a pocket defined by and between a back panel and a front panel and having an open top and closed opposite sides and a closed bottom, with an infant headrest extension on said back panel projecting substantially beyond said open end, and an overlap extending from said closed bottom end and of a length about equal to the length of said pocket structure, and comprising:

folding said overlap into substantially covering relation to said front panel of said pocket structure; and enwrapping a pair of generally aligned ribbon straps, extending from intermediate the opposite sides of said overlap, about said back panel and said folded overlap and tying said straps into a retaining bow over said folded overlap.

12. A method according to claim 11, wherein said front panel has separable flaps, spreading said flaps apart to provide an opening aligned with said open top end for facilitating insertion of an infant into said pocket, and retaining said flaps closed by separable means on said flaps.

* * * * *